US008402763B2

(12) United States Patent
Mulherin et al.

(10) Patent No.: US 8,402,763 B2
(45) Date of Patent: Mar. 26, 2013

(54) COMBUSTOR HEADEND GUIDE VANES TO REDUCE FLOW MALDISTRIBUTION INTO MULTI-NOZZLE ARRANGEMENT

(75) Inventors: Jason Mulherin, Greenville, SC (US); John Charles Intile, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 695 days.

(21) Appl. No.: 12/605,591

(22) Filed: Oct. 26, 2009

(65) Prior Publication Data

US 2011/0094235 A1 Apr. 28, 2011

(51) Int. Cl.

| | |
|---|---|
| ***F02C 1/00*** | (2006.01) |
| ***F02G 3/00*** | (2006.01) |
| ***F23R 3/26*** | (2006.01) |

(52) U.S. Cl. ..... 60/746; 60/759; 60/39.23; 60/747

(58) Field of Classification Search ..... 60/39.23, 60/740, 746, 747, 759, 804, 772

See application file for complete search history.

(56) References Cited

U.S. PATENT DOCUMENTS

| | | | | |
|---|---|---|---|---|
| 2,782,597 | A * | 2/1957 | Parsons et al. | 60/746 |
| 2,885,858 | A * | 5/1959 | Lloyd | 60/747 |
| 4,408,461 | A * | 10/1983 | Bruhwiler et al. | 60/737 |
| 4,967,561 | A * | 11/1990 | Bruhwiler et al. | 60/737 |
| 5,351,475 | A * | 10/1994 | Ansart et al. | 60/804 |
| 5,660,045 | A * | 8/1997 | Ito et al. | 60/737 |
| 6,047,551 | A | 4/2000 | Ishiguro et al. | |
| 6,298,667 | B1 * | 10/2001 | Glynn et al. | 60/737 |
| 6,594,999 | B2 * | 7/2003 | Mandai et al. | 60/722 |
| 6,634,175 | B1 * | 10/2003 | Kawata et al. | 60/746 |
| 7,117,677 | B2 * | 10/2006 | Inoue et al. | 60/737 |
| 7,185,494 | B2 | 3/2007 | Ziminsky et al. | |
| 7,523,614 | B2 * | 4/2009 | Tanimura et al. | 60/737 |
| 2006/0101814 | A1 * | 5/2006 | Saitoh et al. | 60/377 |
| 2010/0218501 | A1 * | 9/2010 | York et al. | 60/737 |

* cited by examiner

*Primary Examiner* — William H Rodriguez
*Assistant Examiner* — Carlos A Rivera
(74) *Attorney, Agent, or Firm* — Nixon & Vanderhye, P.C.

(57) ABSTRACT

A combustor for a gas turbine includes a plurality of nozzles provided in an array; a baffle plate configured to provide a desired air flow distribution to the array of nozzles; and a casing comprising a plurality of holes in an outer surface. The casing extends from a headend of the combustor to the baffle plate. A method of distributing an air flow in a combustor of a gas turbine includes providing an air flow to the outer surface of the casing; directing the air flow around the baffle plate; and distributing the air flow through the baffle plate to the array of nozzles.

12 Claims, 3 Drawing Sheets

COMBUSTOR HEADEND GUIDE VANES TO REDUCE FLOW MALDISTRIBUTION INTO MULTI-NOZZLE ARRANGEMENT

This invention relates to flow distribution to the headend of a multi-nozzle combustor.

BACKGROUND OF THE INVENTION

Industrial gas turbines have a combustion section typically formed by an annular array of combustors. Each combustor is a cylindrical chamber which receives gas and/or liquid fuel and combustion air which are combined into a combustible mixture. The air-fuel mixture burns in the combustor to generate hot, pressurized combustion gases that are applied to drive a turbine.

The combustors are generally dual mode, single stage multi-burner units. Dual mode refers to the ability of the combustor to burn gas or liquid fuels. Single stage refers to a single combustion zone defined by the cylindrical lining of each combustor.

Stabilizing a flame in a combustor assists in providing continuous combustion, efficient generation of hot combustion gases and reduced emissions from combustion. The flames of combustion tend to oscillate due to dynamic pressure fluctuations in the combustors especially during combustion transition operations to lean fuel-air mixtures. These oscillations can extinguish the flame in a combustor and fatigue the combustor.

A single stage combustor for a gas turbine may comprise an annular array of outer fuel nozzles arranged about a center axis of the combustor and a center fuel nozzle aligned with the center axis. A pressure drop across the combustor is used to split an air flow to the combustor. However, the pressure drop may result in a maldistribution of the air flow to the outer fuel nozzles.

BRIEF DESCRIPTION OF THE INVENTION

According to one sample embodiment, a combustor for a gas turbine comprises a plurality of nozzles provided in an array; a baffle plate configured to provide a desired air flow distribution to the array of nozzles; and a casing comprising a plurality of holes in an outer surface, wherein the casing extends from a headend of the combustor to the baffle plate.

According to another sample embodiment, a method is provided for distributing an air flow in a combustor of a gas turbine. The combustor comprises a plurality of nozzles arranged in an array, a baffle plate, and a casing extending from a headend of the combustor to the baffle plate and having a plurality of holes in an outer surface The method comprises providing an air flow to the outer surface of the casing; directing the air flow around the baffle plate; and distributing the air flow through the baffle plate to the array of nozzles.

DETAILED DESCRIPTION OF THE INVENTION

Figure 1:
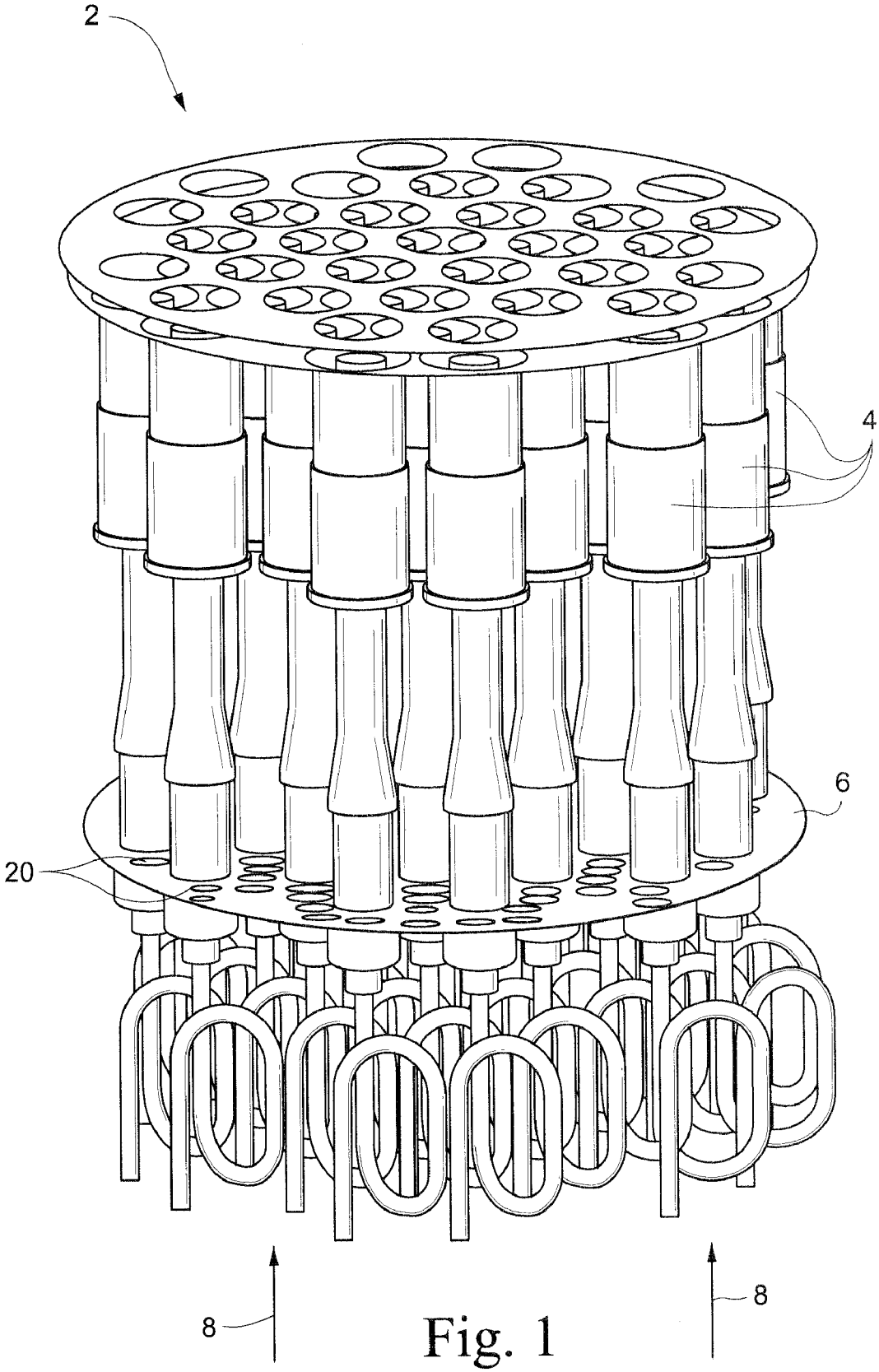
FIG. 1 schematically depicts a multi-nozzle combustor according to an embodiment.

Referring to FIG. 1, a multi-nozzle combustor 2 comprises a plurality of nozzles 4. Flow distribution to the headend of a multi-nozzle combustor 2 is provided by a tuned baffle plate 6 to force the air flow 8 to the outer nozzles.

The baffle plate 6 comprises a plurality of holes that may be configured to provide a desired flow distribution to the nozzles 4. The air flow 8 is distributed to the nozzles 4 by the baffle plate 6 without a significant effect on the pressure drop. However, the baffle plate 6 may cause the pressure drop to increase. The baffle plate 6 may be provided with holes 20 of different sizes.

Figure 2:
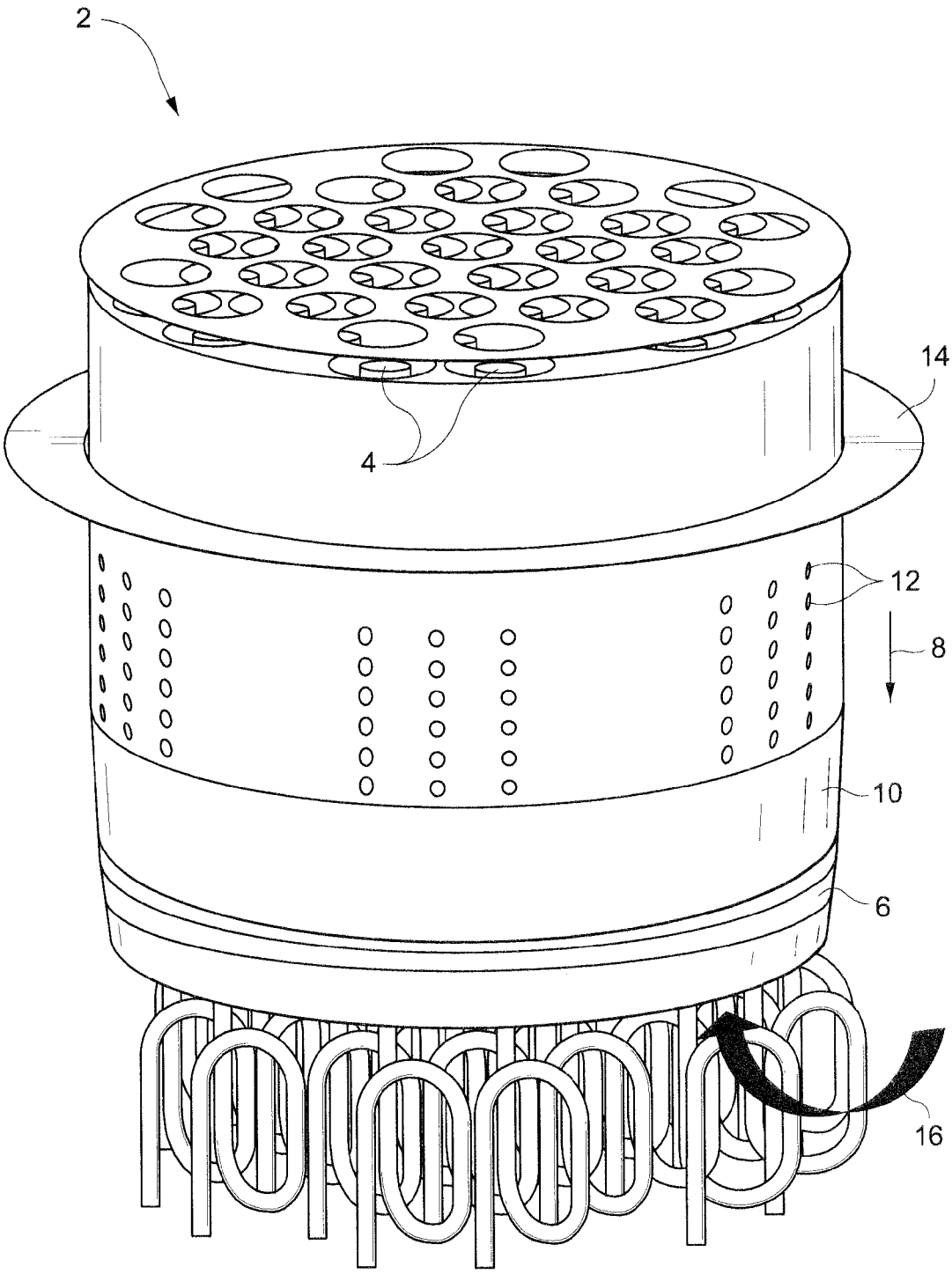
FIG. 2 schematically depicts the multi-nozzle combustor as shown in FIG. 1 with a side casing.

Referring to FIG. 2, the combustor 2 may comprise a casing 10 that comprises a plurality of holes 12. The air flow 8 enters the headend of the combustor 2 through a flowsleeve inlet 14 and then flows down the outside of the casing 10. The flowsleeve inlet 14 may be adjusted to achieve a desired pressure drop.

The air flow 8 turns up at the bottom of the combustor 2 as shown by arrow 16 and comes up through the baffle plate 6. Some of the air flow 8 may be extracted by the holes 12 in the casing 10.

Figure 4:
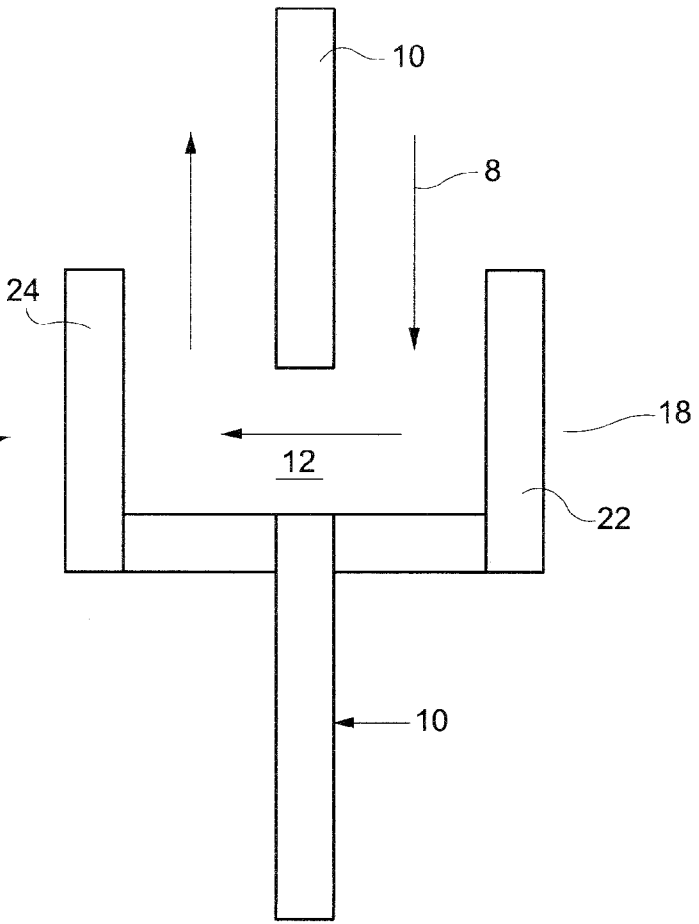
FIG. 4 schematically depicts air flow through the combustor of FIG. 3.
Figure 3:
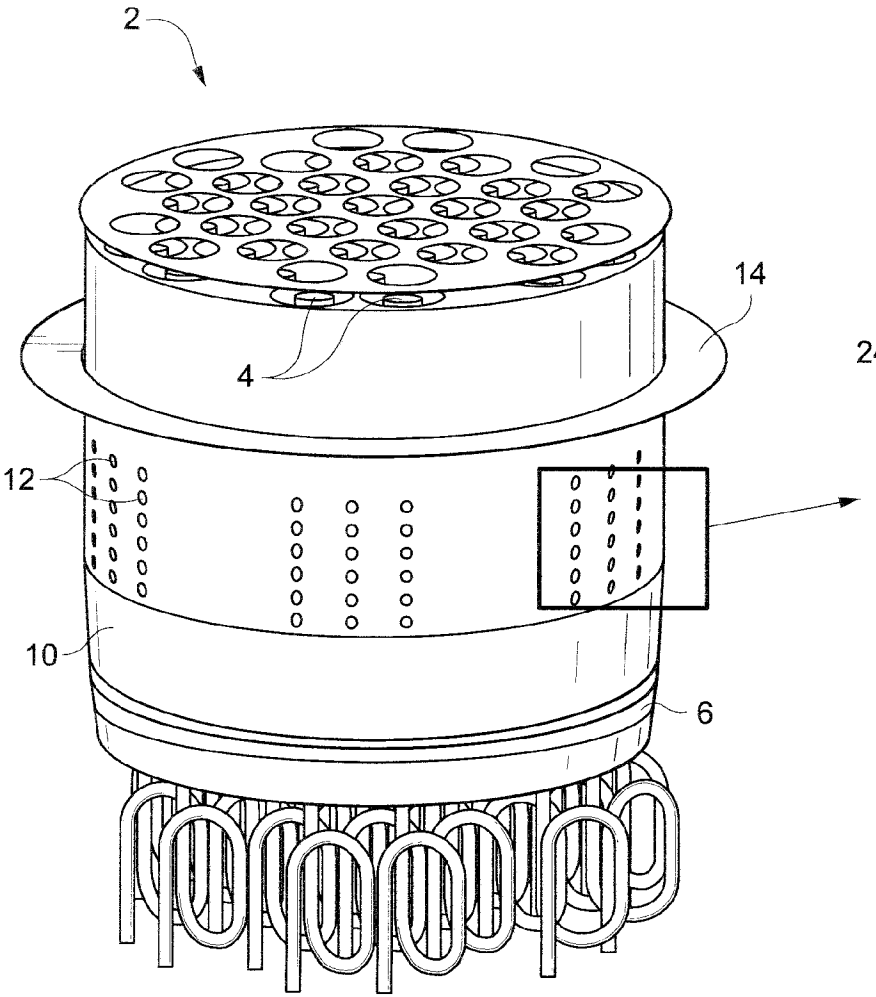
FIG. 3 schematically depicts a multi-nozzle combustor according to an alternative embodiment.

Referring to FIGS. 3 and 4, the combustor 2 may comprise a guide vane 18 that extends around the entire circumference of the casing 10. The guide vane 18 may be positioned axially along the casing 10. As shown in FIG. 4, the guide vane 18 comprises an outer side, or scoop, 22 that captures the air flow 8 and forces it into the casing 10. The guide vane 18 turns the air flow 8 inwards to feed underflowed outer nozzles. The guide vane 18 may also include an inner side, or scoop, 24 to guide the air flow 8 to the outer nozzles. It should be appreciated that the guide vane 18 may not include an inner side, or scoop.

The guide vane 18 may be provided in sections to permit the casing 10 to support the guide vane 18. It should also be appreciated that although the sides 22, 24 of the guide vane 18 are shown as generally parallel to the casing 10, the sides 22, 24 of the guide vane 18 may be provided at an angle to the casing 10. In addition, it should be appreciated that the length of the sides 22, 24 of the guide vane may be configured to provide a desired distribution of the air flow to the nozzles.

The guide vane 18 and the flowsleeve inlet 14 may each be configured for individual combustors. The flow sleeve inlet may be adjusted at the end of the design to get a desired pressure drop. The guide vane may provide an allowance of flow maldistribution to the outer nozzles. That allowance may be used at the end of the combustor to get the desired flow distribution.

The baffle plate does not rely on pressure drop to provide the desired flow split. The baffle plate also does not have a significant effect on the pressure drop.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustor for a gas turbine, comprising:

a plurality of nozzles provided in an array;

a baffle plate configured to provide a desired distribution of air flow to the array of nozzles;

a casing comprising a plurality of holes in an outer surface, wherein the casing extends from a headend of the combustor to the baffle plate and a guide vane located around the outer surface of the casing between the headend and the baffle plate, the guide vane including a first side on the outer surface of the casing and a second side on an inner surface of the casing configured to provide a desired distribution of the air flow to the plurality of nozzles.

2. The combustor according to claim 1, wherein the baffle plate is tuned to direct a portion of the air flow to outer nozzles of said array.

3. The combustor according to claim 2, wherein the plurality of holes of the baffle plate comprise a plurality of sizes.

4. The combustor according to claim 1, further comprising:

a flowsleeve inlet through which the air flow enters the headend of the combustor.

5. The combustor according to claim 1, wherein a portion of the air flow along the outer surface of the casing is extracted by said second plurality of holes in the outer surface of the casing.

6. The combustor according to claim 1, wherein the guide vane extends around the entire circumference of the casing.

7. The combustor according to claim 1, wherein the guide vane comprises a plurality of sections.

8. The combustor according to claim 1, wherein the first and second sides are parallel.

9. A method of distributing an air flow in a combustor of a gas turbine, the combustor comprising a plurality of nozzles arranged in an array, a baffle plate, and a casing extending from a headend of the combustor to the baffle plate and having a plurality of holes in an outer surface, the method comprising:

providing an air flow to the outer surface of the casing;

directing the air flow around the baffle plate;

distributing the air flow through the baffle plate to the array of nozzles;

providing a guide vane located around the outer surface of the casing between the headend and the baffle plate, the guide vane having a first side on the outer surface of the casing and a second side on an inner surface of the casing configured to provide a desired distribution of the air flow to the plurality of nozzles.

10. The method according to claim 9, wherein the plurality of holes in the baffle plate are different sizes.

11. The method according to claim 9, further comprising:

extracting a portion of the air flow through the plurality of holes in the outer surface of the casing.

12. The method according to claim 11, wherein the guide vane extends around the entire circumference of the casing.

* * * * *